United States Patent [19]

Zibold

[11] 4,253,438

[45] Mar. 3, 1981

[54] RPM REGULATOR FOR FUEL INJECTION PUMPS WITH AN ADAPTATION OF THE INJECTION QUANTITY

[75] Inventor: Karl Zibold, Asperg, Fed. Rep. of Germany

[73] Assignee: Robert Bosch GmbH, Stuttgart, Fed. Rep. of Germany

[21] Appl. No.: 4,235

[22] Filed: Jan. 17, 1979

[30] Foreign Application Priority Data

Jan. 24, 1978 [DE] Fed. Rep. of Germany ..... 2802888

[51] Int. Cl.[3] ..... F02D 31/00; F02M 41/00

[52] U.S. Cl. ..... 123/366; 123/368; 123/449; 123/179 G; 123/179 L

[58] Field of Search ..... 123/139 ST, 140 R, 139 BD, 123/179 G, 179 L

[56] References Cited

U.S. PATENT DOCUMENTS

| | | | |
|---|---|---|---|
| 2,836,162 | 5/1958 | Dressler | 123/139 ST |
| 3,672,343 | 6/1972 | Biechl et al. | 123/140 R |
| 3,970,064 | 7/1976 | Eheim et al. | 123/139 ST |
| 3,974,812 | 8/1976 | Konrath | 123/139 ST |
| 4,132,206 | 1/1979 | Straubel et al. | 123/140 R |
| 4,148,290 | 4/1979 | Knorreck | 123/140 R |

*Primary Examiner*—Ira S. Lazarus
*Assistant Examiner*—Magdalen Moy
*Attorney, Agent, or Firm*—Edwin E. Greigg

[57] ABSTRACT

An rpm regulator for fuel injection pumps of internal combustion engines having a starting lever, which is coupled on one side with a fuel quantity setting member and on the other side with an rpm governor, which contacts the starting lever with an rpm dependent force in opposition to an arbitrarily variable force of a main control spring, which is included in series with the main control spring and is deformable up to a first stop. A further spring, also deformable up to the first stop, is provided parallel to the starting spring for the purpose of adaptation of the fuel injection quantity. It is proposed to provide a second stop in addition to the first stop, at least in the full load range, by means of which the starting lever can be blocked in the direction of the first stop from the time an adaptation rpm is attained and before it reaches the first stop. By utilizing such an internal combustion engine in a vehicle, a smooth driving mode is attained because a positive adaptation can be switched off by means of the second stop in the full load range and thus is not effective in that range. The adaptation of the fuel injection quantity in the partial load range, however, is fully retained.

16 Claims, 5 Drawing Figures

RPM REGULATOR FOR FUEL INJECTION PUMPS WITH AN ADAPTATION OF THE INJECTION QUANTITY

BACKGROUND OF THE INVENTION

The invention relates to an rpm regulator for fuel injection pumps of the type described, for example, in U.S. Pat. No. 3,970,064. In the distributor-type injection pump there employed, the fuel supply quantity increases with increasing rpm. This increase is compensated for by the disposition of a further spring (adaptation spring), so that over the entire regulatory range, when the rpm increases, only a limited increase in the fuel injection quantity, or none at all, takes place; and this is particularly true in the full load range. However, this proves to be disadvantageous for the vehicle driving mode, particularly with respect to the acceleration mode. It would be more favorable in that event to maintain an increasing fuel injection quantity at full load with increasing rpm as well; but to maintain an increasing fuel injection quantity at partial load only in the lower rpm range.

OBJECT AND SUMMARY OF THE INVENTION

It is an object of the present invention to improve the rpm regulator of the type noted above in which an adaptation of the fuel injection quantity takes place only in the partial load range, but not near the full load range, so that at partial load there is available an increased fuel injection quantity for the purpose of rapid acceleration, and in particular so that when gasoline is injected for the purpose of engine cooling, there is a sufficiently rich fuel mixture available.

In order to attain this object it is proposed that a preliminary or second stop be provided in addition to a known stop, or first stop, by means of which a starting lever can be blocked in the stop direction at least in the full load range beyond a certain rpm before it reaches the first stop.

By means of the second stop, which becomes effective at least in the full load range, the effect of a further spring, whose purpose is the adaptation of the fuel injection quantity, is blocked in the full load range. As a result, a characteristic which is maintained by further means, such as hydraulic means, is fully retained in the full load range, while in the partial load range the advantages of the adaptation come into play and thus a particularly favorable partial load fuel consumption is attainable, which has particularly favorable consequences for the average fuel consumption in vehicles.

In order to assure that the second stop becomes effective only in the full load range, it may be controlled advantageously via a full load, or third stop. The second stop itself may efficiently comprise a supplementary lever cooperating with the starting lever and the third stop. The supplementary lever is embodied as a two-armed lever pivotably fixed on the drag lever, whereby one arm serves as the second stop and cooperates with the starting lever, and the other arm cooperates with the third stop in the full load range. The supplementary lever may be particularly simply and stably embodied when it is U-shaped in cross section and one of the U-shaped legs has an extension which cooperates with the third stop. In order to save space, the drag lever may be disposed between the legs of the supplementary lever.

The adaptation rpm, from which the adaptation begins as the rpm increases, may be particularly easily adjusted by varying the relative position of the further spring with respect to the starting lever, if the further spring is provided on the starting lever. The further spring can equally well be disposed on the drag lever and then cooperate with the starting lever.

In order to obtain a better gradation of the effectiveness of the first stop in the range shortly before the full load range, a further full load or fourth stop may be provided supplementary to the third stop which acts on the second stop. This fourth stop, which is preferably adjustable, acts directly upon the starting lever or the drag lever, whereby both stops may be independently adjustable. A particularly simple construction is obtained when the two full load stops are combined and formed, for example, by an eccentric pin having a projection.

DESCRIPTION OF THE PREFERRED EMBODIMENT

Figure 1:
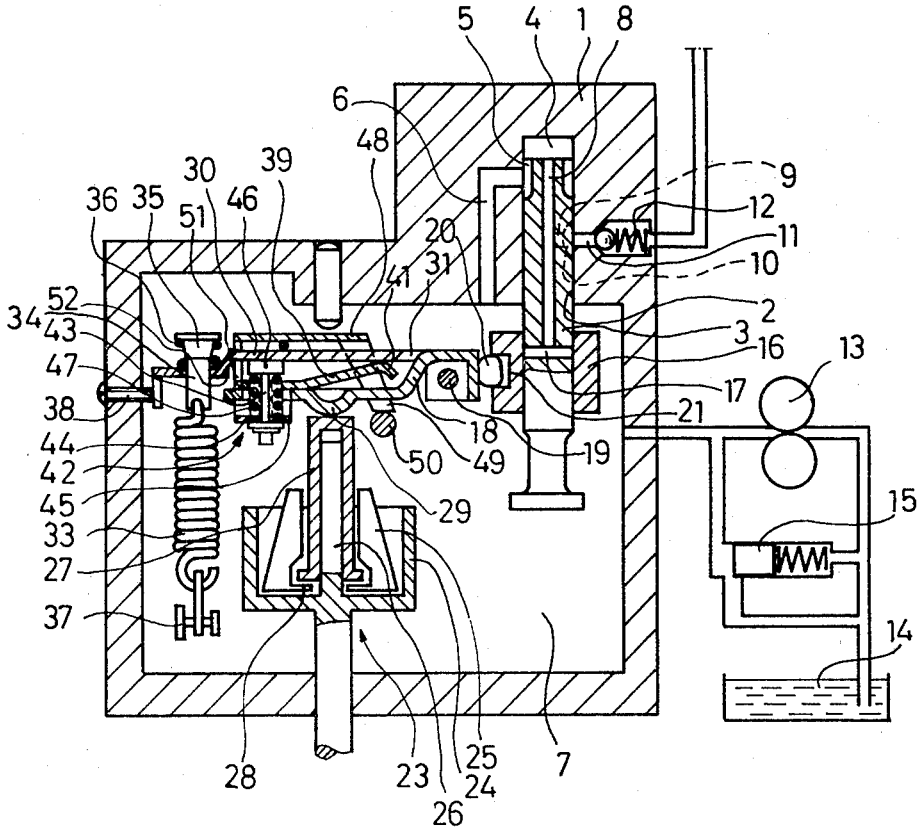
FIG. 1 is a section through a distributor injection pump with an rpm regulator in schematic form.
Figure 2:
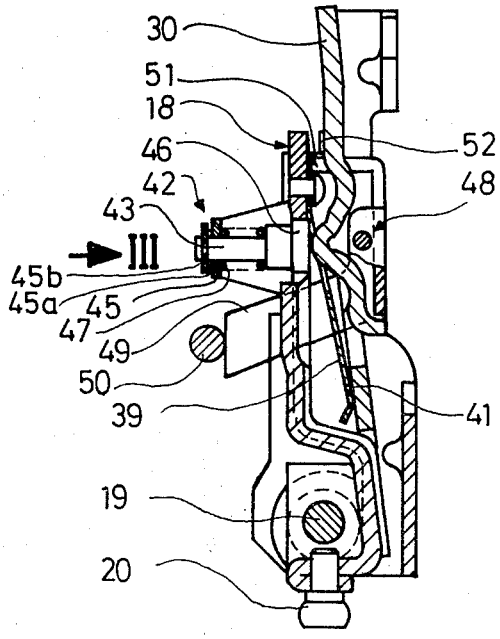
FIG. 2 is a partial section, corresponding to the section of FIG. 1, showing the starting lever, the drag lever, and the supplementary lever is larger scale.
Figure 3:
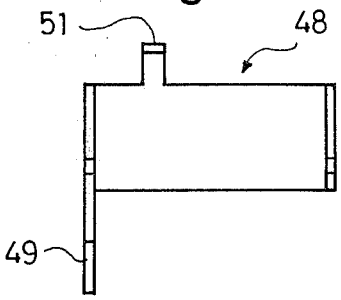
FIG. 3 is a view of the supplementary lever in the direction of the arrow III of FIG. 2.

A housing 1 of a fuel injection pump is provided with a cylindrical bore 2 in which a pump piston 3 is received. The pump piston 3 executes a simultaneous rotating and reciprocating motion in response to the action of drive means (not shown) and in opposition to a restoring spring (not shown). The bore 2 and pump piston 3 define a working chamber 4. The working chamber is provided with fuel by a longitudinal groove 5 formed in the outer surface of the pump piston 3 and by a channel 6 within the housing 1. The channel 6 provides a passage for the fuel from a suction chamber 7. Fuel delivery takes place while the pump piston 3 executes its suction stroke, or while it is located in its bottom dead center position. As soon as the pressure stroke of the pump piston 3 has begun and after an appropriate rotation of the pump piston 3, the channel 6 is closed and the fuel located in the pump working chamber 4 is delivered into a longitudinal channel 8 extending within the pump piston 3. From this channel 8, the fuel is further delivered to a radial bore 9 and a longitudinal distributing groove 10 formed in the outer wall of the pump piston 3 and finally to one of a plurality of pressure lines 11. The number of pressure lines 11 is equal to the number of engine cylinders to be supplied with fuel and these lines are distributed about the circumference of the cylindrical bore 2. Each of the pressure lines 11 leads to a check valve 12 opening in the direction of fuel delivery and to an injection valve (not shown) disposed near the individual cylinders of the internal combustion engine.

The suction chamber 7 is supplied with fuel by a fuel pump 13 which takes fuel from a fuel storage container 14. The pressure in the suction chamber 7 is controlled in a known manner by a pressure control valve 15 disposed in parallel with the fuel supply pump 13.

Slidably located on the pump piston 3 is a delivery quantity adjustment member in the form of an annular slide member 16 which controls the aperture of a radial bore 17 formed in the pump piston 3 and communicating with the longitudinal channel 8. By effecting this control during the pressure stroke of the pump piston 3, the slide member 16 determines the end of fuel delivery or the fuel quantity delivered by the pump 13 to the pressure lines 11. After the aperture of the radial bore 17 has been opened, fuel flows back into the suction chamber 7.

The annular slide member 16 is displaced by a starting lever 18 pivotably mounted about a shaft 19 rigidly inserted into the housing 1. The lever 18 is provided with a head 20 which engages a recess 21 in the annular slide member 16. The other end of the starting lever 18 engages a centrifugal force governor 23 which is an rpm signal generator. The centrifugal force governor 23 is driven at pump piston rpm by gears (not shown). The centrifugal force governor 23 includes a carrier 24 holding flyweights 25, a shaft 26, and a sleeve 27. The sleeve 27 is slidably disposed with respect to the shaft 26, and its lower end is engaged by projections 28 of the flyweight 25 so that, when the flyweights move outwardly due to centrifugal forces, the sleeve 27 is axially displaced on the shaft 26 and, at the same time, it displaces the starting lever 18 and hence the annular side member 16.

At the point where the sleeve 27 engages the starting lever 18, the lever 18 is provided with a hemispherical bulge 29 to achieve a frictionless and torque-free transmission of the setting motion of the centrifugal force governor.

A single-arm drag lever 30 is pivotably mounted on the same shaft 19 but independently of the starting lever 18. The lever 30 is symmetric with respect to the starting lever 18 and has a recess 31 into which the starting lever 18 extends, so that both levers 18 and 30 can be pivoted independently of one another. The ends of both levers also overlap.

A main control spring 33 pivots at the end of the drag lever 30. This main control spring 33 is a tensile spring whose one end is fastened at a bolt 34 which penetrates the drag lever 30 in a bore therein and which is provided with a head 35 on the opposite side of the lever 30. An idling spring 36 may be located between the head 35 and the drag lever 30. The other end of the control spring 33 engages an arbitrarily settable lever 37. An adjustable full load or fourth stop 38 for the drag lever 30 may also be provided. The fourth stop 38 is formed by a rotatable bolt, screw or pin with an eccentric end which may be rotated to change the setting position of the drag lever.

Both the drag lever 30 and the starting lever 18 are bent so that, when the levers attach to one another, a space similar to a parallelogram is formed between them. In this position, both levers extend substantially parallel to one another. Extending into the space between the drag lever 30 and the starting lever 18 is a leaf spring 39 serving as the starting spring. The leaf spring 39 is bent substantially medially of its length at an angle away from and then back again toward the centrifugal regulator 23 and furthermore has a tongue-like end 41 bent upward, which contacts the drag lever 30. The starting spring 39 tends to press the two levers 18 and 30 apart.

Furthermore, there is an adaptation capsule 42 provided on the starting lever 18, which is open on the side toward the drag lever 30. The capsule 42 has disposed within it a bolt 43, which is guided within a bore 44 in the floor of the capsule and has a stop 45 in the form of a safety ring 45*a* with discs 45*b* at its outermost end, outside the capsule. The end of the bolt 43 adjacent the drag lever 30 has a head 46, which serves as a stop of a further spring 47. The spring 47 is compressed between the stop 46 and the floor of the capsule 42. By means of interposing discs 45*b* of the stop 45, the pre-stressing of the spring 47 and also the amount of projection of the head 46 can be varied.

The head 46 projects outward above the starting lever 18 when the levers 18, 30 are not pressed against each other. Thus the head 46 serves first as a stop between the drag lever 30 and the starting lever 18. Only when the rpm increases and when the adjustment forces derived from the centrifugal governor 23 increase is the bolt 43 gradually displaced against the force of the spring 47, until it comes to a flat position between the drag lever 30 and the starting lever 18. This displacement simultaneously effects a displacement of the annular slide 16 and a reduction of the injection quantity supplied. Only when the shut-off rpm n''' (FIGS. 4 and 5) is reached is the force of the main regulator spring 33 thereafter overcome by means of the sleeve 27 force and the annular slide 16 displaced further downward, in the direction of a minimum fuel supply quantity, or the interruption of the same, as may be seen from FIGS. 4 and 5.

Thus, by means of the adaptation capsule 42, a positive adaptation or an adaptation in the regulatory sense is achieved, which means that the full load characteristic curve, which, as an example, normally runs parallel, adopts a slight slope, which is determined by the spring characteristic of the spring 47 and the adjustment path of the bolt 43.

Figure 5:
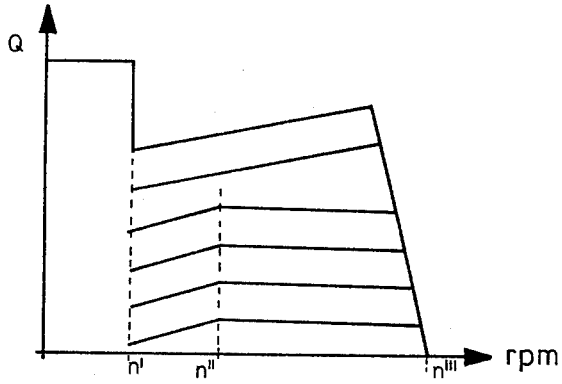
FIG. 5 shows the performance graph of FIG. 4, in which the positive adaptation is eliminated in the full load range by means of the supplementary lever.

In order now to eliminate the adaptation in the full load range, a supplementary lever 48 is pivotably supported on the drag lever 30. This supplementary lever 48 is wider than the drag lever 30 and is U-shaped in cross section, so that the supplementary lever 48 and the drag lever 30 can be disposed in a space-saving manner with only a small distance between them. One of the lateral sides of the two-armed supplementary lever 48 has an extension 49, which cooperates with a full load or third stop 50 fixed in the housing 1 when the drag lever 30 is close to its full load position. The supplementary lever 48 has a bent portion which cooperates with the starting lever 18, which bent portion serves as a second stop 51 and prevents the starting lever 18 from coming into contact with a first stop 52 of the drag lever 30 in the full load range. By this means, the adaptation is eliminated by overbridging the spring 47 in the full load range, so that the performance graph in the full load range shows an increasing injection quantity at increasing rpm. In the partial load range, meanwhile, a constant or decreasing injection quantity is produced by means of the adaptation, as is shown in FIG. 5.

Figure 4:
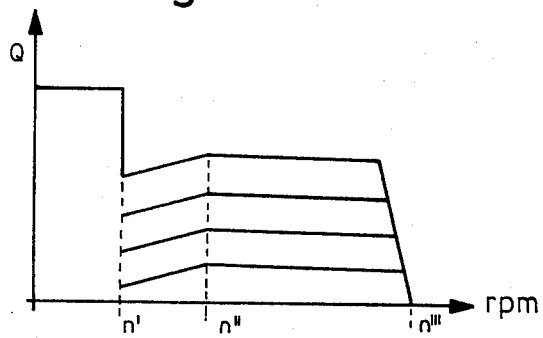
FIG. 4 is a regulatory performance graph in which the positive adaptation operates over the entire load range.

The injection quantity regulation in the injection pump described above operates as follows:

Depending on the position of the annular slide 16, the radial bore 17 and thus the relief connection from the working chamber 4 to the pump suction chamber 7 is opened sooner or later during the compression stroke, that is, during the delivery stroke of the pump piston 3, and thus fuel delivery into the pressure lines 11 is interrupted. Thus, in the uppermost position of the annular slide 16, the maximum fuel quantity, that is, the entire fuel quantity delivered by the pump piston 3, is conveyed to the pressure lines 11. The farther downward the annular slide 16 is displaced, the earlier the radial bore 17 is opened and the fuel delivery interrupted. In the illustrated starting position in FIG. 1, the drag lever 30 contacts the fourth stop 38, while the starting lever 18 is pressed by means of the leaf spring 39 onto the sleeve 27 of the centrifugal governor 23. Simultaneously with the deflection of the starting lever 18, the control slide 16 is moved into its uppermost position, which corresponds to the delivery of an excess fuel quantity (FIGS. 4 and 5, rpm below n'). After the engine is started, the flyweights 25 are deflected outwardly by the increasing rpm, so that the sleeve 27 is displaced upwardly and, with increasing rpm, pivots the starting lever 18 against the force of the starting spring 39 until it abuts the head 46 on the drag lever 30. At this instant, the excess fuel quantity is reduced to the normal full load quantity. In further operation, at a further increase of the rpm up to the attainment of the rpm value n'' (FIGS. 4 and 5), no further displacement of the starting lever 18 with respect to the drag lever 30 will take place. At a further rpm increase, the further spring 47 is fully compressed, so that at increasing rpm, a limited reduction takes place of the fuel injection quantity, and, as may be seen from FIGS. 4 and 5, the supply curves beyond this rpm n'' are flatter. In the full load range, the full compression of the spring 47 is prevented by the second stop 51, so that only the supply quantity in the full load range increases at increasing rpm in accordance with the pumping characteristic of the distributor injection pump. In the partial load range, the second stop 51 is not effective; here, the adaptation is effected by the functioning of the spring 47. When the rpm value n''' is attained, the force of the centrifugal governor 23 becomes so great that the force of the main regulator spring 33 is overcome and a decrease of the fuel injection quantity takes place by means of pivoting the levers 18 and 30.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. In an improved rpm regulator of a fuel injection pump for internal combustion engines, including: a housing; a fuel quantity setting member; a starting lever, one end of which engages the fuel quantity setting member; a drag lever mounted relative to said starting lever; a pivot shaft which pivotably mounts the starting lever to the injection pump; a first stop mounted on said drag lever; a main control spring; means for mounting one end of said control spring to said housing; means for arbitrarily changing the force exerted by the main control spring; a starting spring mounted between said starting lever and said drag lever in series with the main control spring and being deformable up to the first stop; an rpm governor mounted to said housing which engages the starting lever and exerts an rpm-dependent force in opposition to the forces of the main control spring and the starting spring, and a further spring deformable up to the first stop and provided in parallel to the starting spring for adaptation of the fuel injection quantity, the improvement comprising:

a supplementary lever supported by said drag lever, said supplementary lever comprising a second stop, said second stop cooperating with said starting lever, by which the starting lever can be blocked in the direction of the first stop, at least in the full load range from the time an adaptation rpm is reached and before the first stop is reached;

a third stop supported by said housing, said third stop cooperating with said supplementary lever and serves as a full load stop for controlling said second stop.

2. The rpm regulator as defined in claim 1, wherein the supplementary lever is embodied as a two-armed lever and is pivotably supported on the drag lever, with one arm of said supplementary lever serving as the second stop cooperating with the starting lever, and with the other arm of said supplementary lever cooperating with the third stop in the full load range.

3. The rpm regulator as defined in claim 2, wherein the supplementary lever is pivotably supported on the drag lever, on the side thereof lying opposite the starting lever, and wherein the second stop is formed by a portion of the supplementary lever guided laterally past the drag lever.

4. The rpm regulator as defined in claim 2, wherein the supplementary lever is pivotably supported on the drag lever, on the side thereof lying opposite the starting lever, and wherein the second stop is formed by a portion of the supplementary lever guided laterally through a hole in the drag lever.

5. The rpm regulator as defined in claim 2, wherein the supplementary lever is U-shaped in cross-section, with one of the U-shaped legs having an extension cooperating with the third stop.

6. The rpm regulator as defined in claim 5, wherein the supplementary lever is pivotably supported on the drag lever, on the side thereof lying opposite the starting lever, and wherein the second stop is formed by a portion of the supplementary lever guided laterally past the drag lever.

7. The rpm regulator as defined in claim 5, wherein the supplementary lever is pivotably supported on the drag lever, on the side thereof lying opposite the starting lever, and wherein the second stop is formed by a portion of the supplementary lever guided laterally through a hole in the drag lever.

8. The rpm regulator as defined in claim 1, wherein the adaptation rpm is adjustable by means of varying the relative position of the further spring with respect to the starting lever.

9. The rpm regulator as defined in claim 1, wherein the improvement further comprises a fourth stop rotatably secured in said housing serving as a further, preferably adjustable, full load stop, which acts directly upon the starting lever.

10. The rpm regulator as defined in claim 9, wherein the third and fourth stops are combined with each other.

11. The rpm regulator as defined in claim 10, wherein the third and fourth stops are formed by an eccentric bolt having a projection.

12. The rpm regulator as defined in claim 1, wherein the improvement further comprises: a fourth stop, said fourth stop serving as a further preferably adjustable, full load stop, which acts directly upon the drag lever.

13. The rpm regulator as defined in claim 12, wherein the third and fourth stops are combined with each other.

14. The rpm regulator as defined in claim 13, wherein the third and fourth stops are formed by an eccentric bolt having a projection.

15. The rpm regulator as defined in claim 1, wherein:

said supplementary lever is U-shaped and having legs and said drag lever is disposed between said legs of said U-shaped supplementary lever.

16. The rpm regulator as defined in claim 6 or 7, wherein:

said portion of said supplementary lever that forms said second stop is a bent portion.

* * * * *